United States Patent [19]

McDonnell

[11] 3,999,160

[45] Dec. 21, 1976

[54] MODULAR TRAFFIC SIGNAL APPARATUS

[76] Inventor: Richard M. McDonnell, Rte. 5, Box 360, Decatur, Ala. 35601

[22] Filed: Dec. 5, 1975

[21] Appl. No.: 638,273

[52] U.S. Cl. ..... 340/119; 340/84; 339/166 R; 330/119 R; 200/307; 317/117; 240/73 QD; 46/25

[51] Int. Cl.[2] ..... E01F 9/00

[58] Field of Search ..... 340/119, 41 R, 41 A, 340/42, 87, 84, 321; 339/119 L, 120, 121, 125 R, 127 C, 132 R, 132 B, 166 R, 119 R, 47, 91 F; 200/307, 308, 309; 40/52 R; 35/19 A; 46/24, 25, 26, 226, 228; 317/117; 325/355, 356; 116/63 R, 63 P; 312/11

[56] References Cited

UNITED STATES PATENTS

| | | | |
|---|---|---|---|
| 2,401,171 | 5/1946 | Leppert | 340/84 |
| 2,784,388 | 3/1957 | King et al. | 340/84 |
| 3,484,984 | 12/1969 | Fischer | 46/25 |
| 3,594,689 | 7/1971 | Hopt et al. | 35/19 A |
| 3,696,548 | 10/1972 | Teller | 46/228 |
| 3,706,070 | 12/1972 | Eikenberry | 340/119 R |

*Primary Examiner*—John W. Caldwell
*Assistant Examiner*—Donnie L. Crosland
*Attorney, Agent, or Firm*—Jones, Thomas & Askew

[57] ABSTRACT

Traffic signal apparatus in which individual signal units are of modular construction and include complementary structure for direct mechanical and electrical interconnection with like signal units, or with a mounting member for supporting an array of interconnected signal units. Each individual signal unit is prewired, and all necessary wiring interconnections for an interconnected array of individual signal units are accomplished by electrical connectors which mate as the individual signal units are mechanically interconnected with each other. Each signal unit includes a lamp socket assembly which is readily connectable to the prewiring, so that any desired signal circuit can be selected for each signal unit. The lamp socket assemblies are adjustable to permit proper orientation of lamp filaments. The disclosed interconnectable individual signal units are intended for plug-in assembly to form desired traffic signal arrays which require no wiring, apart from electrical interconnection with a conventional source of traffic control signals.

9 Claims, 11 Drawing Figures

MODULAR TRAFFIC SIGNAL APPARATUS

This invention relates in general to traffic signal apparatus and in particular to traffic signal units and related apparatus which can be readily interconnected into desired traffic signal arrays.

Traffic signal lamp apparatus of the type popularly known as "stop lights" are generally constructed from a number of individual signal units, each of which provides an individual signal light function, so that the overall assemblage provides the desired combination of signal functions for a particular traffic control location. In addition to the typical go-caution-stop lights, signal light units for turn arrows and other traffic and/or pedestrian movement control may be incorporated into an overall traffic signal array.

Heretofore, each individual signal unit of a traffic signal array has been affixed to adjacent units, or to a hanger assembly, by using hardware such as threaded pipe nipples, bolts, or similar hardware requiring substantial amounts of time for assembling an overall traffic signal array which not infrequently includes five individual traffic signal units. Each individual signal unit of the prior art was assembled to provide the desired traffic signal array, and the units were then manually wired, typically by installing wires from the lamp socket in each signal unit to a terminal strip provided in one of the units. After the aforementioned manual assembly and manual wiring of a traffic signal array, in the prior art, the array was then mounted on a pole bracket or overhead cable with suitable interconnecting hardware which typically permits angular positioning of the traffic signal array at only certain discrete angular positions along a horizontal plane. Once the traffic signal array is thus mounted, the electrical leads from the signal control mechanism must be manually wired to the aforementioned terminal strip mounted in one of the individual signal units of the array.

It will be understood that traffic signal apparatus of the type described above requires a substantial degree of manual assembly, either at the point of installation or at a workshop immediately prior to installation. Furthermore, any post-installation change in one or more of the signals may require substantial manual rewiring of the affected signal units.

Accordingly, it is an object of the present invention to provide improved traffic signal apparatus.

It is another object of the present invention to provide traffic signal apparatus in which an overall traffic signal array is quickly and easily assembled from individual identical modular signal units.

It is a further object of the present invention to provide individual traffic signal units which are prewired, and which are readily interconnectable to establish mechanical and electrical interconnection of separate units to provide a desired traffic signal array.

Stated in general terms, the foregoing and other objects of the present invention are met by traffic signal apparatus including modular signal units having a lamp housing and provided with complementary mechanical and electrical quick-disconnect means which are readily attachable and detachable from other such signal units. The electrical circuit connective means are positioned so that circuit interconnection between adjacent units is made or broken as the units are mechanically connected or disconnected, and the signal units are prewired between the electrical connective means. Each signal unit is provided with a lamp socket assembly which is readily connectable to any prewired circuit within the signal unit, and the lamp socket is also positionable to permit the individual lamps to be positioned in accordance with manufacturer's instructions regarding filament positioning.

The objects and advantages of the present invention are more readily understood with reference to the disclosed preferred embodiment thereof, as shown and described with respect to the drawings in which.

Figure 1:
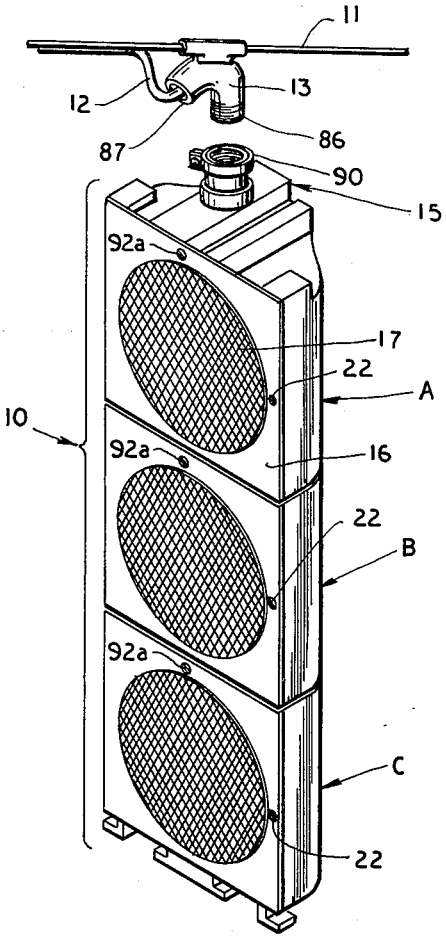
FIG. 1 shows a pictorial view of an assembled traffic signal array according to the disclosed embodiment of the present invention.

Turning to FIG. 1, there is seen generally at 10 a typical traffic signal array which is suspended in downwardly depending relation from a support cable 11. The support cable 11, it will be understood, may extend across a street or roadway and the traffic signal array 10 may be but one of several such arrays which can be suspended from the cable. It will also be understood that the traffic signal array 10 can be mounted on poles or posts positioned at the side of the roadway, in conventional fashion. An electrical cable 12 containing operating circuits for the signal array 10 extends along the cable 11 and enters the cable entrance fitting 13, which may be of conventional construction.

The traffic signal array 10 of the disclosed embodiment is made up of three separate signal modules or units A, B, and C, along with a mounting plate 15 which is connected to the upper side of signal unit A and which is, in turn, interconnected with the entrance fitting 13 in a manner to be described below. The three interconnected signal units A–C may respectively present the conventional traffic signal colors red, amber, and green, and it is to be understood that one or more additional signal units may be attached depending downwardly from signal unit C; such additional signal units could display turn arrows, pedestrian control information, or other traffic control information.

Figure 2:
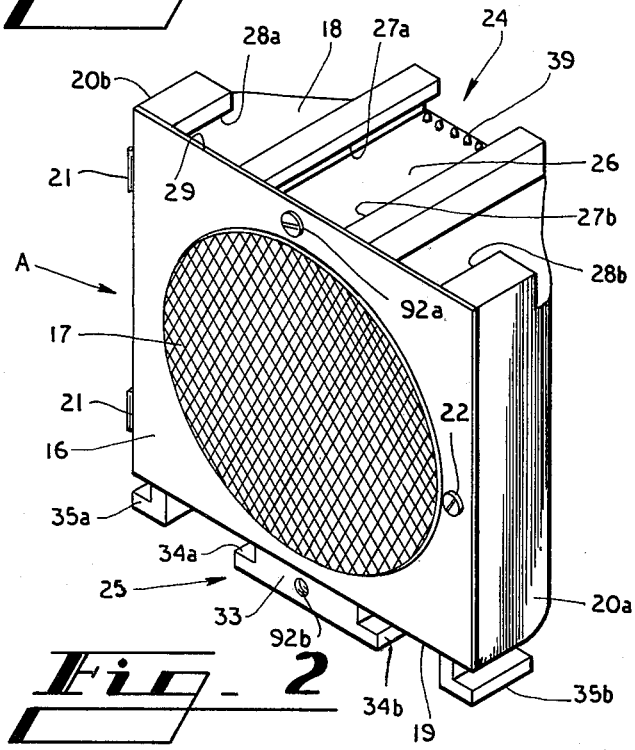
FIG. 2 shows a pictorial view of an individual signal unit of the type used in the signal array of FIG. 1.

Each of the individual signal units A, B, and C is identical in the disclosed embodiment (except for lens color), and the signal unit A seen in FIGS. 2–6 is typical of each such signal unit. Turning first to FIG. 2, it is seen that the signal unit A has a front panel 16 in which is mounted a lens 17 which may be a combination lens-color filter of conventional construction. The signal unit A has a top wall 18 and a bottom wall 19, and side walls 20*a* and 20*b* which may be of any suitable configuration. The front panel 16 of each signal unit is attached by hinges 21 on the side wall 20*a* and by a suitable fastener 22, such as a captivated bolt, to permit ready access to the interior of the signal unit.

The top wall 18 of each signal unit, including signal unit A, is provided with quick-connect attachment structure 24 which is complementary to the quick-connect attachment structure 25 provided on the bottom wall 19 of each such signal unit. The top attachment structure 24 on each signal unit of the disclosed embodiment is provided by the inverted-T slot 26 defined by the two overhanging flanges 27*a* and 27*b*. The two flanges 28*a* and 28*b*, respectively located at the upper intersecting corners of the front panel 16 with the side walls 20*a* and 20*b*, also form part of the top attachment structure 24. It is seen in FIG. 2 that the corner flanges 28*a* and 28*b*, along with the flanges 27*a* and 27*b* which define the inverted-T slot 26, are substantially flush in elevation with the upper edge 29 of the front panel 16. The bottom attachment structure 25 includes an inverted-T flange 33 extending in front-to-back relation along the bottom wall 19. The inverted-T flange includes a pair of flange members 34*a* and 34*b* which extend laterally of the inverted-T flange, and the overall inverted-T flange 33 is in complementary configuration with the inverted-T slot 26. The bottom attachment structure 25 includes a pair of corner flanges 35*a* and 35*b* in complementary configuration to the top corner flanges 28*a* and 28*b*.

It will now be understood that two separate signal units, such as A and B, are mechanically interconnected simply by sliding the inverted-T flange 33, on the bottom of signal unit A, into the inverted-T slot 26 on the top of signal unit B. The corner flanges 35*a* and 35*b* of signal unit A, which project downwardly below the lower edge 36 of the front panel 16, are received beneath and in engagement with the top corner flanges 28*a* and 28*b* of the signal unit B, further providing a positive mechanical interconnection between the two adjacent signal units. The weight of signal unit B (as well as any additional signal units attached below B) is thus supported by the corner flanges 35*a* and 35*b* of signal unit A, as well as by the flange members 34*a* and 34*b* of the inverted-T flange 33. The provision of corner flanges in addition to the inverted-T slot and flange allows the supported weight of the signal unit to be distributed along the signal unit structure including the bottom wall 19 and the side walls 20*a* and 20*b*.

An array of electrical contacts 39 is positioned on the top wall 18 within the inverted-T slot 26, and a corresponding number of mating electrical contacts 40 is disposed on the bottom of the inverted-T flange 33 on the lower wall of each signal unit. The upper contacts 39 on each signal unit are of complementary interconnecting construction with the lower contacts 40 on each such signal unit, and the upper contacts are positioned with respect to the top attachment structure 24 so that a contact-to-contact circuit is established with the lower contacts 40 when the aforementioned top attachment is interlocked with complementary bottom attachment structure 25 of another signal unit. The upper contacts 39, in the disclosed embodiment, take the form of contact members which project a distance upwardly from the bottom of the inverted-T slot 26, and which may be resiliently biassed outwardly, while the lower contacts 40 take the form of depressions within which the aforementioned projections are received when adjacent signal units are interconnected. An electrical circuit bus extends between the upper contacts 39 and the lower contacts 40 within each individual signal unit, and it will be understood that the number of electrical contacts and corresponding bus conductors is chosen to accommodate the maximum number of electrical circuits necessary for signal control.

Figure 3:
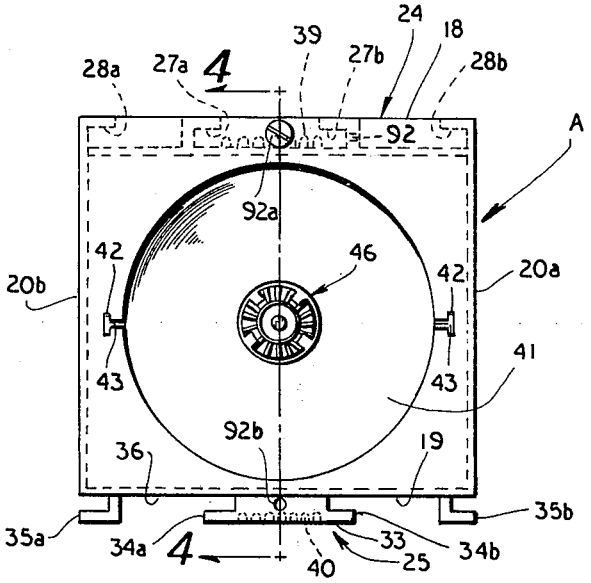
FIG. 3 shows a front elevation view of the signal unit in FIG. 2, with the front lens and surrounding panel removed for illustrative purposes.
Figure 4:
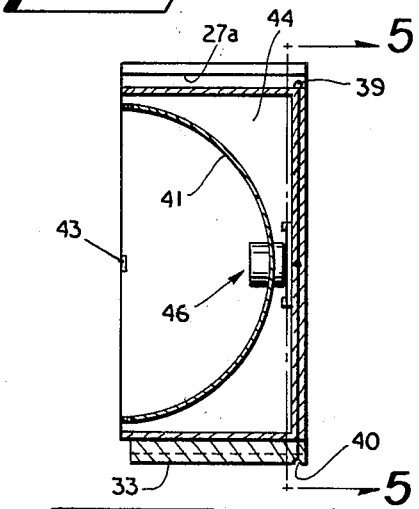
FIG. 4 is a section view taken along line 4—4 of FIG. 3.

Each signal unit internally contains a reflector 41 which is removably located in position by the guide members 42 which are received within slots 43, as shown in FIGS. 3 and 4. The reflector 41 in each signal unit is retained in place behind the front panel 16 and will seldom require removal, inasmuch as the prewired construction of the signal units eliminates the need for access to the interior 44 for wiring or rewiring the electrical circuits found in the conventional traffic signal. A lamp socket assembly 46 is disposed within each signal unit to receive an electric lamp of any conventional construction.

Figure 5:
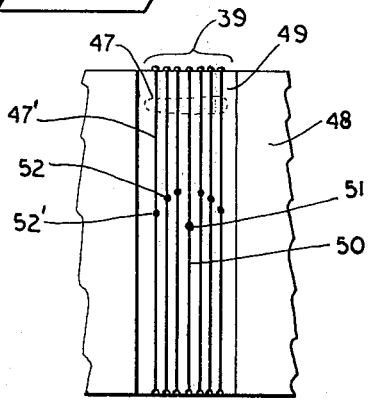
FIG. 5 is a section view taken along line 5—5 of FIG. 4, with the lamp socket assembly removed.

Turning to FIG. 5, there is seen the electrical connector bus 47 which extends along the inside back wall 48 of each signal unit between the upper contacts 39 and the lower contacts 40. The bus 47 may be provided by individual electrical conductors which are molded or otherwise permanently formed into the rib structure 49 extending vertically along the wall 48, if desired. One conductor 50 of the bus 47 is a common or neutral conductor, relative to the other conductors of the bus, and is connected to a socket 51 which may be molded into the rib 49. Each of the remaining conductors of the bus 47 is individually electrically connected to corresponding sockets collectively designated 52, and it is apparent from FIG. 5 that the sockets 52 are arranged on a path which is radially equidistant from the neutral conductor socket 51.

Figure 6:
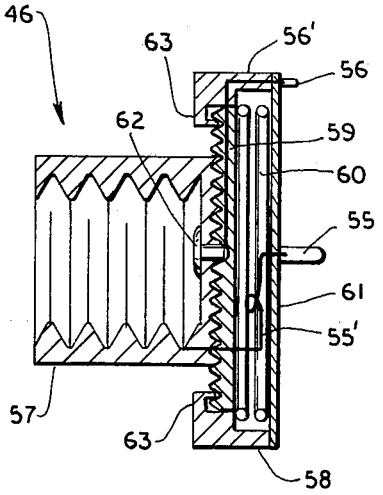
FIG. 6 is an enlarged detail section view of the lamp socket assembly.

The sockets 51 and 52 accommodate the pins 55 and 56, respectively, of the lamp socket assembly 46 which is shown in detail in FIG. 6, and which includes a lamp-receiving socket portion 57 attached to a base portion 58. The base portion 58 includes a socket supporting plate 59 which is urged to the left, as viewed in FIG. 6, by the spring 60 which is disposed between the base and a rear wall 61 of the socket assembly 46. The forward-facing side of the support plate 59 is provided with a plurality of positioning teeth 62, which may be disposed about part or all of the periphery of the support plate, and one or more positioning detents 63 affixed to the base portion 68 are engageable by the positioning teeth 62 to limit the extent of forward movement of the support plate under the influence of the spring 60.

The lamp socket assembly 46 is installed in a particular signal unit A, for example, by inserting the pin 55 into the neutral socket 51 and by inserting the pin 56 into one of the sockets 52 corresponding to a particular desired conductor of the bus 47. If the signal unit A is intended to provide a red "stop" signal, for example, and assuming that the conductor 47′ is connected to receive operating power from the electrical cable 12 when a stock signal is desired, then the pin 56 of the lamp socket assembly is plugged into the socket 52′ which is associated with the conductor 47′.

After the lamp socket assembly 46 is plug-connected to the desired operating circuit of the bus 47, and a suitable lamp is inserted in the socket portion 57, it is usually necessary to rotate the socket portion 57 for the purpose of positioning the lamp filament according to recommendations of the lamp manufacturer. This is accomplished in the present invention by depressing the lamp and the socket portion 57 inwardly of the signal unit A (that is, to the right as seen in FIG. 6) until the positioning teeth 62 of the socket support plate 59 become disengaged from the positioning detents 63. The lamp and lamp socket portion 57 may now be rotated, along with the socket support plate 59, to the position which achieves the proper positioning of the lamp filament, whereupon releasing the lamp allows the positioning teeth of the socket support plate to return into engagement with the positioning detent at urging of the spring 60. The electrical conductors 55' and 56' extending from the respective pins 55 and 56 to the socket portion 57 must obviously allow sufficient length for the necessary amount of socket portion rotation.

It will be apparent that the lamp socket assembly may, at any time, be plug-connected to any available lamp operating circuit simply by connecting the pin 56 with the appropriate socket 52, so that the prewired signal unit A can be interchangeably used to provide any desired traffic signal function merely by appropriate socket positioning and by providing a lens 17 of appropriate color and/or indicia designation.

Figure 9:
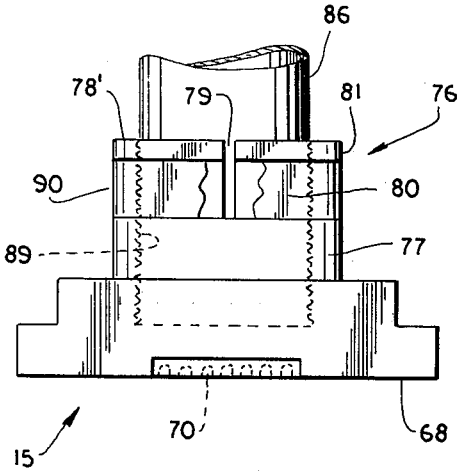
FIG. 9 is a right end elevation view of the mounting plate shown in FIG. 7.
Figure 7:
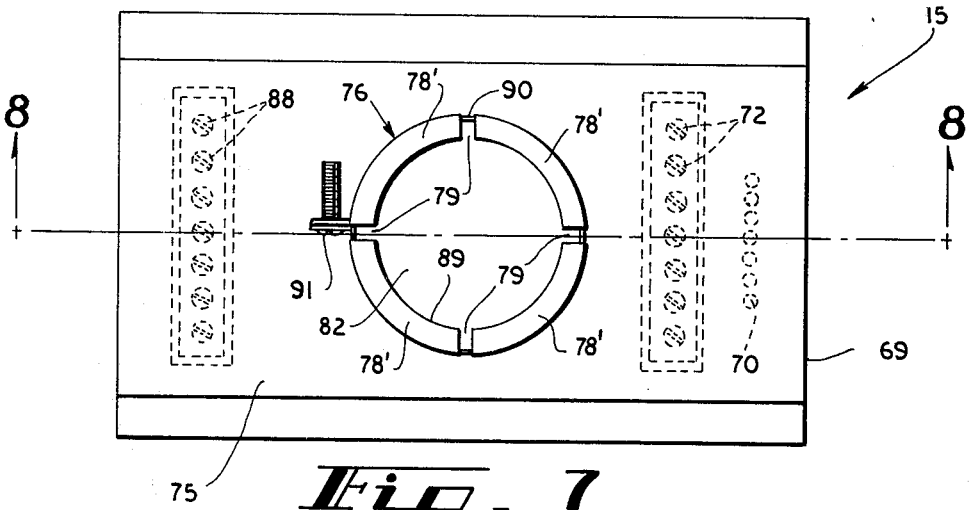
FIG. 7 is a top plan view of a mounting plate according to the disclosed embodiment of the present invention.
Figure 8:
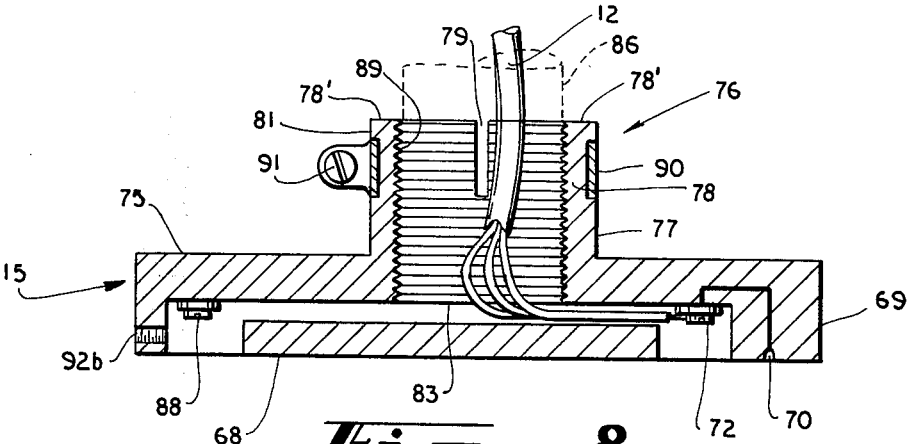
FIG. 8 is a section view taken along line 8—8 of FIG. 7.

Details of the mounting plate 15, which interconnect a traffic signal array 10 with a suitable support such as the overhead cable 11 or any other appropriate support, are seen in FIGS. 7–9. The downward-facing side 68 of the mounting plate 15 has an inverted-T flange 69 which is configured for complementary engagement with the inverted-T slot 26 on each of the individual signal units. The inverted-T flange 69 on the mounting plate may, accordingly, be substantially similar to the corresponding flanges 33 on each of the individual signal units. The inverted-T flange 69 includes a set of lower contacts 70 designed for complementary contacting engagement with the upper contacts 39 associated with each top attachment structure 34 on the individual signal units, so that the lower contacts 70 are moved into electrical engagement with corresponding upper contacts 39 on a signal unit A, for example, when the inverted-T flange 69 is slidably inserted into the inverted-T slot 26 of that signal unit. Electrical leads 71 extend from each individual contact 70 to a corresponding individual terminal element, such as a connecting screw or the like, of the terminal strip 72 which is preferably mounted on the underside 68 of the mounting plate 15 for protection from the weather.

Extending upwardly from the upper surface 75 of the mounting plate 15 is the mounting connector 76. The mounting connector 76 of the disclosed embodiment includes a solid lower annular ring 77, which is secured to the mounting plate 15, and an upper annular ring 78 which is split into a number of sectors 78' by the longitudinal slots 79. A circumferential channel 80 is formed around the exterior of the upper ring 78, as best shown in FIG. 9, leaving a rim 81 projecting outwardly from the channel 80 at the upper side thereof. Both the lower ring 77 and the contiguous interconnected upper ring 78 are hollow as indicated at 82, and an opening 83 extends from the upper surface 75 of the mounting plate 15, in alignment with the hollow interior 82, to provide access for the electrical signal cable 12 which is to be connected to the terminal strip 72.

The mounting plate 15 is used in the following manner. The typical entrance fitting 13 shown in FIG. 1 is a hollow tubular member having a lower end 86 provided with external pipe threads, and an offset upper end 87 into which the electrical cable 12 is inserted. The individual leads of the electrical cable 12 are first drawn downwardly through the aligned hollow interior 82 and the opening 83 of the mounting plate, whereupon individual electrical leads are attached to the terminal strip 72. Additional terminal points 88 may be provided on the underside 68 of the mounting plate 15, if desired, to serve merely as junction points for splicing circuit conductors extending to other traffic signals mounted on a common support cable 11.

Once the electrical interconnections are completed, the mounting plate 15 is moved upwardly to place the threaded lower end 86 of the entrance fitting within the hollow interior 82 of the mounting connector 76. Although the inner surface defining the hollow interior 82 is provided with annular grooves 89, it will be understood that the nominal diameter of the hollow interior is slightly larger than the outside diameter of the pipe threads on the lower end 86, so that the threaded lower end of the entrance fitting is freely receivable within the hollow interior 82. The mounting plate 15 is now rotated on a horizontal plane to achieve an angular position at which the elongate dimension of the mounting plate, as seen in FIGS. 1, 7, and 8 in the disclosed embodiment, is aligned with the desired direction of traffic signal display. At this time, a clamping ring 90 is disposed around the upper ring 78 within the channel 80. The clamping ring 90 may take the form of a conventional hose clamp, for example, so that tightening the screw 91 causes the clamping ring to constrict the channel 80 and deform the sections 78' of the upper ring 78 inwardly. This inward deformation forces the annular grooves 89 into a tight clamping engagement with the pipe threads on the lower end 86 of the entrance fitting 13, with the result that the mounting plate 15 is securely attached to the entrance fitting. The mounting plate 15 can now be attached to the uppermost signal unit A in a traffic signal array 10, thereby automatically achieving circuit interconnection between the electrical cable 10 and the interconnected circuit buses 47 within each of the already interconnected signal units A, B and C. It will be understood that the angular orientation of the signal array 10, in a horizontal plane, is accurately defined by the previously described angular orientation of the mounting plate 15. The horizontal angular positioning of the mounting plate and the signal array is infinite, and is not limited by detents or click-stop adjustments as typically found in prior art signal apparatus.

Many components of the present signal apparatus can be molded from plastic materials having suitable weather-resistant capabilities, therefore providing a more durable signal apparatus which can be fabricated in modules that are relatively inexpensive, when compared with present traffic signal construction. The upper ring 78 of the mounting connector 76, for example, can be of resiliently deformable plastic material so that the mounting plate can be readily removed from the entrance fitting, or repositioned thereon, simply by loosening the clamping ring 90. The signal array 10 can be readily removed and replaced with a substitute signal array, if desired, without requiring any rewiring or realignment of the mounting plate 15 or of the substitute signal array. The sliding interconnection between each adjacent signal unit, and between the mounting plate and the uppermost signal unit of an array, can be secured by a fastener 92*a*, such as a captivated bolt or the like, which engages a mating opening 92*b* found on the front of each inverted-T flange 33.

Figure 10:
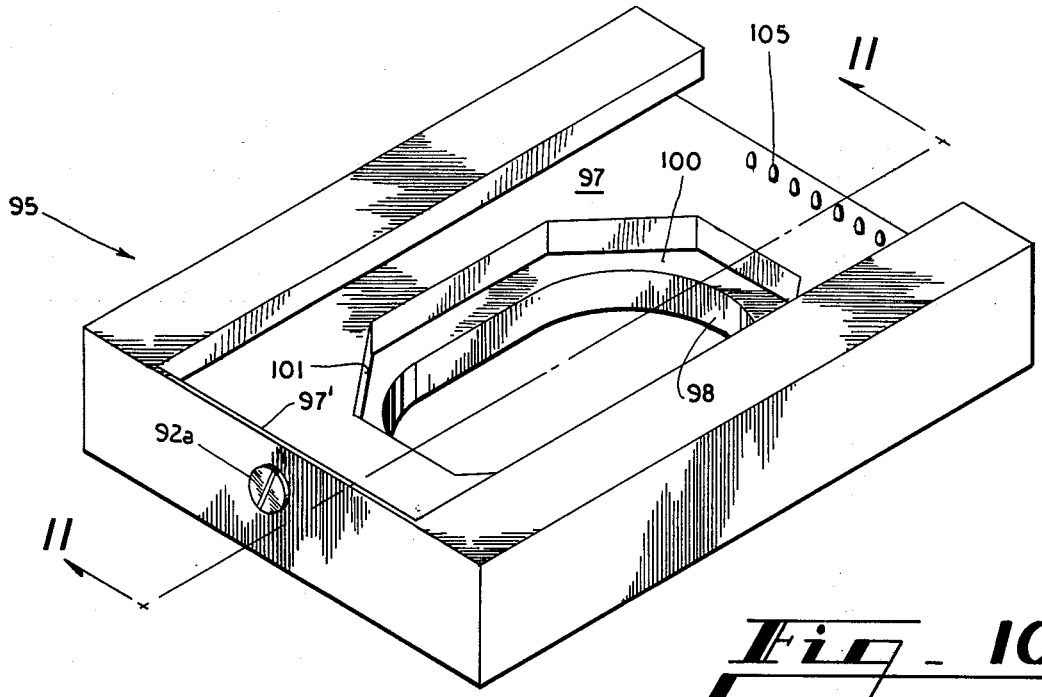
FIG. 10 is a pictorial view of an adapter plate for use in connecting a conventional traffic signal unit to a mounting plate of the type shown in FIGS. 7–9.
Figure 11:
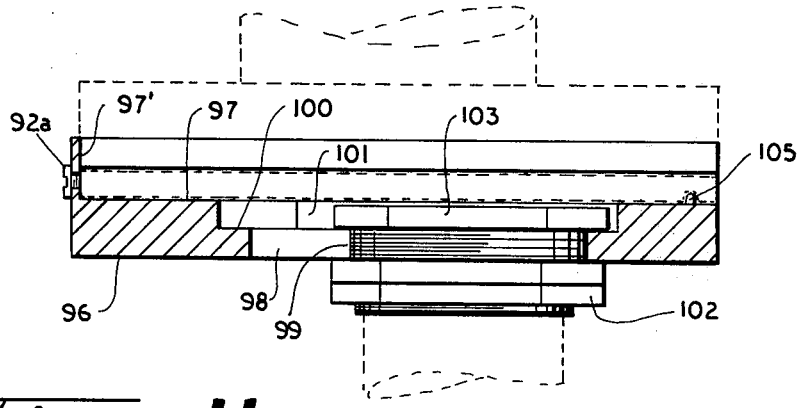
FIG. 11 is a section view taken along line 11—11 of FIG. 10.

The mounting plate 15 can also be used with prior art traffic signals, through the use of an adapter 95 as shown in FIGS. 10 and 11. The adapter 95 includes an elongate flat plate 96 having an inverted-T slot 97 formed therein to receive the inverted-T flange 69 formed on the underside of the mounting plate 15. An elongate opening 98 is formed through the plate 96, along the bottom of the slot 97, to accommodate a conventional mounting nipple 99 extending on the top of a conventional traffic signal array for mounting purposes. The opening 98 is surrounded by a countersunk portion 100, facing the slot 97, for the purpose of receiving the threaded locking ring 101 which screws onto the mounting nipple 99.

The adapter 95 is used by inserting the aforementioned conventional mounting nipple 99, found on the upper end of a conventional traffic signal, through the opening 98 in the inverted-T slot 97. It may be necessary to place one or more additional threaded rings 102 on the mounting nipple 99 before placing the adapter 95 thereon, so that the upper surface 103 of the locking ring 101 is maintained below the portion of the inverted-T slot 97 to be occupied by the inverted-T flange 69 of the mounting plate 15. Once the locking ring 101 is tightened to secure the adapter 95 to the mounting nipple 99, suitable electrical leads 104 are hand-wired to the array of upper contacts 105 within the inverted-T slot 97 of the adapter. The adapter 95 can now be connected to a mounting plate 15 simply by sliding the inverted-T flange of the mounting plate into the inverted-T slot 97 of the adapter, thereby establishing electrical interconnection between the lower contacts 70 of the mounting plates and the upper contacts 105 of the adapter. The slot 97 on the adapter 95 is provided with a forward wall 97' which defines the maximum forward movement of the mounting plate flange relative to the adapter slot. A fastener 92*a* is provided in the forward end of the slot 97 for engagement with a mating opening 92*b* on the mounting plate.

It will be apparent that the foregoing relates to a preferred embodiment of the present invention, and that numerous changes and modifications may be made therein without departing from the spirit and the scope of the invention as defined in the following claims.

I claim:

1. Traffic signal apparatus comprising:

a signal module having a pair of mutually spaced apart wall members;

each of said wall members having mechanical interconnective means which is selectively attachable in mechanical interlocking relation with complementary interconnective means of another signal module;

electrical circuit connective means associated with each said interconnective means and operative to establish a plurality of predetermined electrical circuit interconnections with complementary circuit connective means of said other signal module upon attachment therewith;

electrical bus means extending between said circuit connective means associated with each of said mechanical interconnective means; and lamp means disposed in said signal module and operative to establish an electrical circuit between said lamp means and a selected circuit of said electrical bus means, so that a plurality of said signal modules can be interconnected to provide an electrically interconnected prewired traffic signal array.

2. Apparatus as in claim 1, wherein:

said lamp means includes a lens positioned between said pair of wall members; and each of said mechanical interconnective means comprises elongate connector structure on said wall members extending on a plane perpendicular to said lens to provide a sliding quick connection with complementary structure of such other signal module.

3. Apparatus as in claim 2, wherein:

said elongate connector structure on one of said walls includes an elongate slot having an open end; and said elongate connector structure on the other of said walls includes an elongate flange which is slidably enterable into the open end of a complementary elongate slot in said other signal module for mechanical interconnection therewith.

4. Apparatus as in claim 2, wherein:

said electrical circuit interconnective means is located relative to said elongate connector structure to be positioned in said complementary circuit interconnection only when said sliding interconnection is completed.

5. Apparatus as in claim 1, wherein:

said lamp means includes a socket to receive a lamp;

a first electrical contact in circuit with said socket and terminating at a central location on said lamp means;

a second electrical contact in circuit with said socket and terminating at a location radially spaced apart from said first electrical contact;

a third electrical contact in circuit with a common conductor of said electrical bus and located to receive said first electrical contact; and a plurality of fourth electrical contacts disposed in radial spaced apart relation about said third electrical conductor, each of said fourth electrical contacts being in circuit with a respective other conductor of said bus and being selectably operative to engage said second electrical contact.

6. Apparatus as in claim 1, wherein:

said lamp means includes a socket to receive a lamp which requires a predetermined orientation, said socket having a lamp receiving portion into which such lamp may be inserted and a base portion on which said lamp receiving portion is supported;

said base portion including means for establishing electrical circuit with said selected circuit of said electrical bus means;

means establishing electrical circuit between said lamp receiving socket and said base portion; and means interconnecting said base portion and said lamp receiving socket to allow said socket to be selectably rotated and retained in any of a number of angular positions with respect to said base portion, so that the angular orientation of a lamp in said socket can be changed.

7. Apparatus as in claim 1, further comprising:

a mounting plate for mechanical and electrical interconnection with a said signal module;

said mounting plate having an under portion on which is disposed connective means which is capable of complementary engagement with said mechanical interconnective means on an upper said end wall of said signal module;

electrical circuit connective means mounted on said under side of said mounting plate in predetermined relation with said connective means thereon to establish predetermined electrical circuit connection with said electrical circuit connective means on said upper end wall of said signal module, so that electrical circuits are established between said bus of said signal module and said mounting plate when interconnected with said signal module;

terminal means carried by said mounting plate and electrically connected to said electrical circuit connective means of said mounting plate, so that signal operating wires can be connected to said terminal means to supply lamp operating power to said signal module; and attachment means for attachment in depending relation to a signal support such as an overhead cable and selectively connectable to said mounting plate to support said mounting plate and interconnected signal module.

8. Apparatus as in claim 7, wherein:

said connection between said mounting plate and said attachment means includes a first connecting member depending downwardly from said attachment means and a second connecting member extending upwardly from said upper side of said mounting plate;

one of said connecting members comprising a nondeformable nipple having an exterior surface provided with protrusions; and the other of said connecting members comprising a deformable receptacle into which said nipple is freely received and which is deformable into retaining engagement with said surface protrusions of said nipple, so that any desired angular orientation of said mounting plate relative to said attachment is maintained.

9. Apparatus as in claim 8, wherein said nipple and said deformable receptacle each have a mating internal passage to receive electrical wires leading to said terminal means.

* * * * *